US005240067A

United States Patent [19]

Hatch

[11] Patent Number: 5,240,067

[45] Date of Patent: Aug. 31, 1993

[54] METHOD AND APPARATUS FOR CONTINUOUS MOLTEN MATERIAL CLADDING OF EXTRUDED PRODUCTS

[75] Inventor: David E. Hatch, Chester, Va.

[73] Assignee: Reynolds Metals Company, Richmond, Va.

[21] Appl. No.: 818,197

[22] Filed: Jan. 8, 1992

[51] Int. Cl.[5] ..... B05C 3/12; B22D 11/00

[52] U.S. Cl. ..... 164/461; 118/410; 118/411; 164/419; 427/434.7

[58] Field of Search ..... 164/461, 419, 267, 268; 427/431, 434.7, 357; 118/405, 125, 410, 411

[56] References Cited

U.S. PATENT DOCUMENTS

| | | | |
|---|---|---|---|
| 310,994 | 1/1885 | Farmer | 164/419 |
| 3,095,973 | 7/1963 | Buigne . | |
| 3,137,389 | 6/1964 | Buigne . | |
| 3,298,353 | 1/1967 | Huffman | 118/411 |
| 3,698,355 | 10/1972 | Heijnis et al. | 118/411 |
| 4,299,187 | 11/1981 | Renegar | 118/411 |
| 4,356,216 | 10/1982 | Gailey et al. | 118/411 X |
| 4,715,207 | 12/1987 | Rudolph . | |
| 4,977,852 | 12/1990 | Ishizuka | 118/410 X |

FOREIGN PATENT DOCUMENTS

| | | | |
|---|---|---|---|
| 59-73116 | 4/1984 | Japan | 164/268 |
| 410624 | 6/1934 | United Kingdom . | |

*Primary Examiner*—J. Reed Batten, Jr.
*Attorney, Agent, or Firm*—Alan M. Biddison

[57] ABSTRACT

The apparatus includes a molten material cladding apparatus comprising a crucible and a molten material dispensing tool engaged therewith. The crucible and molten material dispensing tool form a chamber to retain molten material, the molten material flowing through passageways in the molten material dispensing tool to form menisci in a bore thereof. An extrusion passing through the molten material dispensing tool punctures the menisci, wherein molten material flows through the molten material dispensing tool and clads the outer surface of the extruded product passing therethrough. By using menisci of molten material, a smooth surfaced, uniform thickness clad product is produced having a wide range of cladding thicknesses.

19 Claims, 3 Drawing Sheets

METHOD AND APPARATUS FOR CONTINUOUS MOLTEN MATERIAL CLADDING OF EXTRUDED PRODUCTS

FIELD OF THE INVENTION

The present invention is directed to a method of and an apparatus for continuous cladding of elongated members, such as extruded products, with a molten material, such as metal or plastics. For convenience, the apparatus will hereinafter be referred to as an apparatus for cladding molten metal. The apparatus includes a molten metal cladding tool assembly comprising a crucible and a dispensing tool. The dispensing tool engages the crucible to permit cladding of a molten metal around an extruded product passing through an opening in the dispensing tool. The method of continuous molten metal cladding of extruded products includes providing a meniscus of a molten cladding alloy and passing an extrusion through the meniscus such that the molten metal clads the extruded product.

BACKGROUND ART

In the prior art, various metallurgical processes and apparatus have been proposed for extrusion of metals such as aluminum or aluminum alloys. In addition, apparatus have been proposed to clad or bond metal to the surface of an extruded product. By cladding a metal onto an extruded product, a combination of desired properties can be achieved. The base metal can be selected for cost or structural properties with the cladding metal added for other properties such as surface protection, electrical conductivity or to facilitate bonding in joining processes such as welding or brazing.

U.S. Pat. Nos. 3,095,973 and 3,137,389 to Buigne disclose extrusion cladding apparatus. Each of these patents provides a billet of material which is extruded onto the surface of a tube or core. The cladding metal may be aluminum and may range from 0.01 inches to 0.02 inches or more in thickness.

U.S. Pat. No. 4,715,207 to Rudolph discloses another extrusion device for extruding a cladding onto a core. The core may be any suitable elongated metallic article with the sheath extruded onto the outer surface of the core being aluminum or an aluminum alloy.

Other alternative methods proposed for coating or cladding extruded products include flame spraying methods. In these processes, a metal powder is passed through a high temperature flame to splatter molten droplets of the metal o the surface of the extruded product.

Disadvantages associated with prior art devices designed for extrusion cladding of extruded products include non-continuous process operation. In the apparatus of Buigne, the process has to be stopped to replace the butt of the cladding billet with a new billet. Moreover, the cladding thickness range is limited as a result of performing the cladding using an extrusion process.

Cladding of extruded products using flame spraying techniques are disadvantageous in that the flame spraying operation is performed downstream of the extruding press. As a result, the surface of the extruded product is exposed to the atmosphere prior to the flame spraying operation, such exposure contributing to oxidation of the surface which effects the quality of the adhesion between the extruded product and cladding material. In addition, the flame spraying processes produce a rough or textured surface on the extruded products.

In response to the deficiencies in prior art apparatus and methods for cladding of extruded product, a need has developed to provide an improved apparatus and method for cladding extruded forms.

In response to this need, the present invention provides an improved method and apparatus for continuous molten metal cladding. The present invention provides improved adhesion between cladding metal and an extrusion by reducing or eliminating oxidation of the surface of the extruded product between the extrusion step and the molten metal cladding step. In addition, by using a molten metal cladding source, continuous smooth surface cladding may be achieved with a uniform cladding thickness. None of the prior art discussed above teaches or fairly suggest all of the aspects of the inventive method of and apparatus for a continuous molten metal cladding of elongated members such as extrusion products.

SUMMARY OF THE INVENTION

It is accordingly a first object of the present invention to provide an apparatus for and method of continuous molten metal cladding of extruded products.

It is a further object of the present invention to provide an apparatus including a crucible and dispensing tool assembly, the dispensing tool forming a molten metal meniscus for cladding molten metal to the surface of an extrusion passing through the dispensing tool.

It is a further object of the present invention to provide a continuous molten metal cladding method and apparatus which provides improved adhesion of the cladding material by performing the cladding step immediately following an extrusion step to reduce or eliminate oxidation on the surface of the extruded product.

It is a still further object of the present invention to provide continuous molten metal cladding of extruded products which produces a smooth surfaced clad product having cladding thicknesses as low as 0.001 inches resulting in reduced cladding material consumption and lower operating costs.

A further object of the present invention is to provide a molten metal cladding method and apparatus which provide for continuous cladding using a molten metal dispensing tool having no moving parts.

In satisfaction of the foregoing objects and advantages, there is provided a continuous molten metal cladding tool apparatus including a crucible and a molten metal dispensing tool. The molten metal dispensing tool engages the crucible to form a chamber for holding the molten metal cladding material. The molten metal dispensing tool includes a first opening therethrough to receive an extruded product and a plurality of second openings which provide communication between the molten metal and the first opening. The second openings form menisci as a result of the static pressure of the molten material in the crucible, the temperature and viscosity of the molten material and the size of the second openings. The outer surface of the traveling extruded product breaks the menisci such that the molten metal flows into the first opening, seals the void between the extruded surface and the surface of the first opening and clads the extruded product. The molten metal dispensing tool is removably engagable with the crucible to permit repair, exchange or accommodate extrusions of different sizes and geometries. The crucible may also include heating means to maintain and control the temperature of the molten material and a pressurizing means to maintain and control the static pressure of the molten material within the crucible. A control means is also provided to control the thickness of the cladding on the extrusion product responsive to sensed conditions such as temperature, pressure, extrusion product speed and the like.

There is also provided a method for cladding an elongated product such as an extrusion by forming a meniscus of a molten metal cladding material and passing the elongated product through the meniscus so as to form a cladding on the outer surface of the elongated product.

BRIEF DESCRIPTION OF DRAWINGS

Reference is now made to the drawings accompanying the application wherein.

DESCRIPTION OF THE PREFERRED EMBODIMENTS

Figure 1:
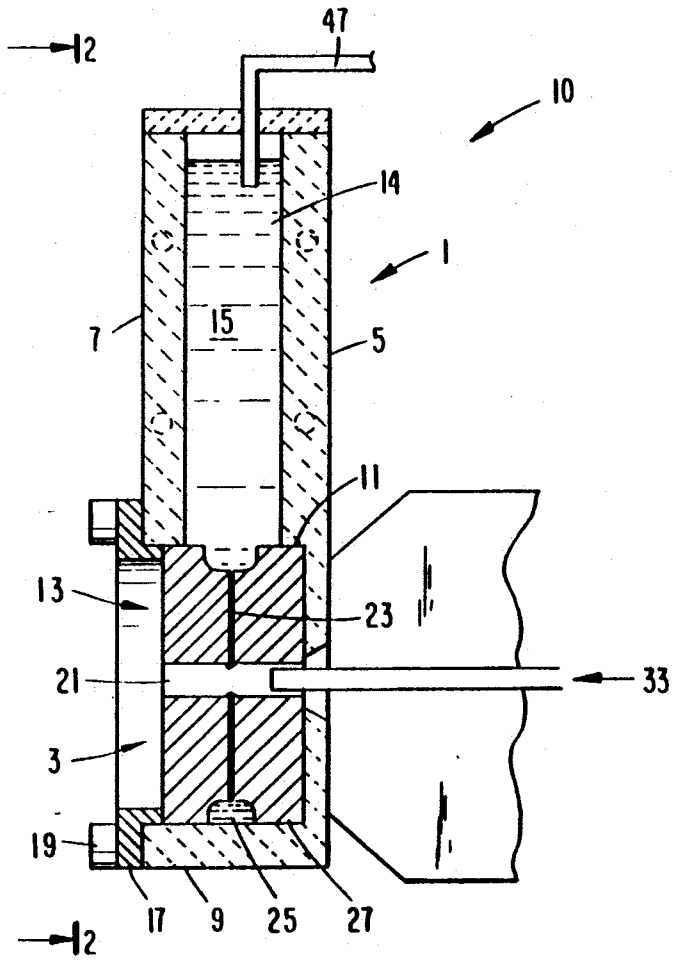
FIG. 1 is a cross-sectional view of one embodiment of the continuous molten metal cladding apparatus provided by the present invention.

The present invention is concerned with a method of and apparatus for continuous molten metal cladding of elongated products such as extrusions and the like. The apparatus of the present invention includes the combination of a crucible and molten metal dispensing tool which combine to form a meniscus of molten metal for cladding of a product passing therethrough.

In prior art devices, extrusions have been clad by forming a cladding on the outer surface thereof using a extrusion process. However, in these prior art devices, continuity of cladding cannot be maintained since the billet used for cladding must be replaced periodically. In prior art flame spray cladding methods, the surface of the extruded product is subjected to oxidation prior to the flame spray cladding process which adversely effects adhesion between the cladding material and extruded product. Moreover, flame spraying techniques generally form a rough cladding outer surface and present explosion hazards due to the presence of metal vapor and powder in the atmosphere.

The inventive method of and apparatus for continuous molten metal cladding of extruded products provides advantages over prior art devices using flame spraying techniques or cladding using extrusion methods. The present invention permits cladding of an elongated member such as an extruded product with a smooth and uniform cladding thickness in ranges heretofore not attainable using extrusion techniques for cladding. Moreover, the cladding of molten metal on the surface of the extrusion product can be performed immediately following the extrusion step such that the surface of the extruded product is free of oxidation prior to cladding. By eliminating an oxide surface on the extruded product, improved adhesion occurs between the cladding molten metal and the extruded product.

By providing a molten metal as a source of cladding material, the cladding operation is only limited by the length of the elongated product passing through the cladding apparatus. In addition, using a molten metal cladding material permits control of the cladding thickness by controlling the viscosity of the molten metal through temperature, static pressure, speed of the extruded product, number and configuration of meniscus forming openings in the dispensing tool or a combination thereof. This control feature permits precise control of the cladding thickness responsive to one or more of the process variables involved during the cladding process.

By utilizing a molten metal dispensing tool which flows a molten metal along the surface of an extruded product, cladding material yield is increased since no material is wasted as in the prior art devices requiring either removal of the butt of a billet during extrusion cladding or collection and disposal of the overspray from a spraying operation. In addition, the molten metal dispensing tool contains no moving parts which simplifies process operation and reduces operating costs due to equipment maintenance With reference to FIGS. 1 and 2, a first embodiment of the continuous molten metal cladding apparatus is generally designated by the reference numeral 10 and is seen to include a crucible 1 and a molten metal dispensing means or tool 3 forming a chamber 14. The crucible 1 includes a front wall 5, a rear wall 7 and side walls 9 extending around the periphery of the crucible and between front and rear walls, 5 and 7, respectively. The front wall 5 includes a step 11 therein and the rear wall 7 includes an opening 13, each of which being adapted to receive and engage the molten metal dispensing tool 3. The tolerances of the opening 13 and step 11 should be sufficiently tight to provide a seal to prevent the molten metal 15 from exiting the crucible 1. Alternatively, sealing means (not shown) may be disposed between the crucible and molten metal dispensing tool to prevent molten metal leakage. The sealing means may be any known type in the art such as a flexible refractory blanket or felt.

The molten metal dispensing tool 3 is removable in nature and may be secured in place by the annular stop 17 and fasteners 19. Although not shown, the fasteners 19 extend through the stop 17 and are threadably engaged in the crucible 1. In this manner, the molten metal dispensing tool may be removed and replaced for purposes of repair or maintenance. In addition, the molten metal dispensing tool 3 may be substituted with a dispensing tool having a different configuration for cladding a differently shaped elongated member.

The molten metal dispensing tool 3 has a disk-shaped configuration having a bore 21 therethrough. The molten metal dispensing tool 3 also includes a plurality of flow passageways 23 which are spaced apart and may be aligned generally perpendicular to the bore 21. The passageways 23, in a preferred embodiment, are positioned in such manner that the desired coating is applied to the entire surface of a product passing through bore 21. In another embodiment, the passageways are positioned to apply spaced apart stripes, rather than a coating covering the entire peripheral surface. The molten metal dispensing tool 3 also includes a channel 25 disposed along the circumferential edge 27 of the molten metal dispensing tool 3.

Figure 2:
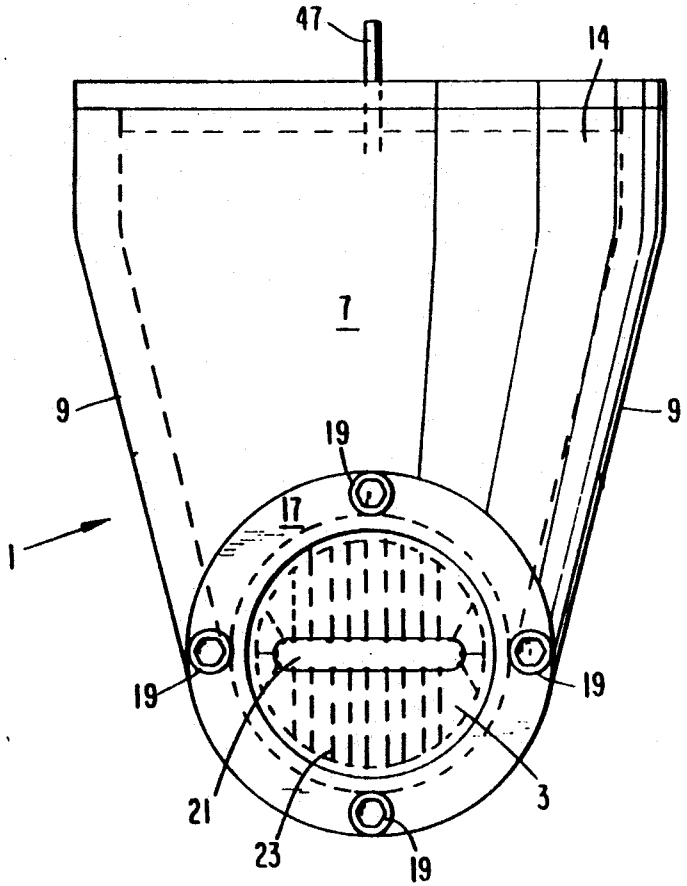
FIG. 2 shows a side view along the line II—II depicted in FIG. 1.
Figure 3:
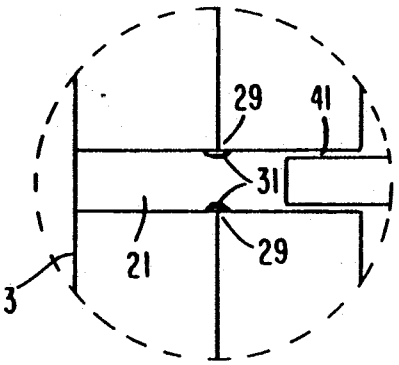
FIG. 3 shows a portion of the molten metal dispensing tool enlarged to show greater detail.

With reference now to FIGS. 1-3, each of the flow passageways 23 terminates at the junction 29 adjacent the bore 21. Formed at each junction 29 is a meniscus 31 of molten metal. It should be understood that the meniscus 31 is formed by a combination of the fluid dynamic properties of the molten metal 15, including the viscosity and temperature of the molten metal and static pressure applied thereto. The size of the flow passageways 23 is based upon a combination of these properties and the speed of the extruded product passing through the bore 21. The channel 25 assists the flow of molten metal through the flow passageways 23, especially those disposed below the bore 21.

Figure 4:
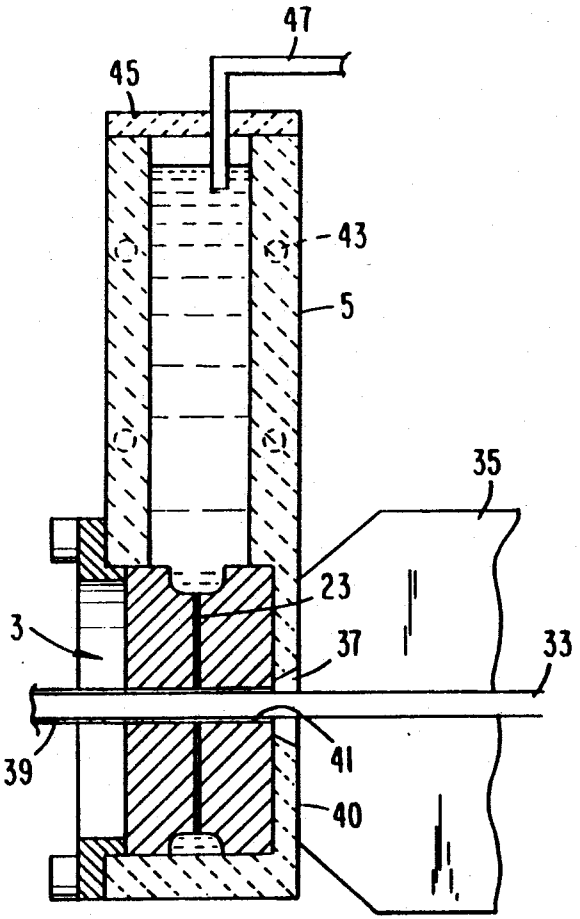
FIG. 4 shows the continuous molten metal cladding apparatus depicted in FIG. 1 with an extruded product being clad.

In operation, and with reference now to FIGS. 1 and 4, the continuous molten metal cladding apparatus is disposed adjacent an exit portion 35 of an extrusion press (not shown). The front wall 5 of the crucible also includes an opening 37 sized larger than the bore 21 to accommodate larger extrusions and corresponding larger bore molten metal dispensing tools. In this manner, the crucible 1 can be utilized for a wide range of extruded product sizes by merely exchanging the molten metal dispensing tool without need for adjustment in size of the opening 37. Alternatively, the opening 37 may be substituted with a removable insert that has an opening therethrough which is sized in conformance with the bore used in the molten metal dispensing tool 3.

In operation, the extruded product 33 punctures the menisci to initiate continuous flow of molten metal 15 through the passageways 23 and around the outer surface of the extruded product 33. The metal 15 solidifies on the product 33 to provide the desired coating. Cooling means (not shown) can be used to expedite the solidification of the coating.

As can be seen from FIG. 4, the extruded product 33 includes a coating 39 on the outer surface thereof exiting the molten metal dispensing tool 3. The coating 39 and extrusion 33, in combination with the menisci 31, protect the outer surface of extruded product 33 from atmospheric air. The face 40 of the extrusion press 35 seals one end of the annulus 41. By preventing atmospheric air from contacting the outer surface of extruded product 33 in this fashion, the extruded product may be immediately clad with the molten metal 15 without risk of oxidation forming on the surface thereof. By eliminating formation of any oxides on the extruded product, improved adhesion is achieved between the cladding material and the extruded product.

In the embodiment depicted in FIGS. 1 and 4, heating means 43 are disposed in the crucible walls 5 and 7 to maintain and control the molten metal 15 in a fluid condition. The crucible 1 is also shown with a top cap 45 and a molten metal supply line 47. The heating means 43 may be any known type such as electrical resistance or induction heating capable of supplying sufficient heat to maintain the molten metal 15 in a fluid state. The heating means may be alternatively positioned directly in the molten metal to maintain fluidity thereof. The crucible may be made out of any material with a preferred material including a refractory having sufficient insulating properties to maintain the molten material fluid without excessive heat loss.

The molten metal dispensing tool 3 may also be made out of any material resistant to the molten metal 15 while permitting the forming of the plurality of flow passageways therethrough. A preferred material for the molten metal dispensing tool would include a high temperature resistant alloy material which can be machined or bored to the desired molten metal tool dispensing configuration. Although the molten metal dispensing tool is illustrated in a circular shape, other configurations may also be used to permit flow of molten metal through the dispensing tool to form the required menisci.

With reference back to FIG. 4, the molten metal supply line 47 may be connected to a molten metal pump or other pressurizing means to supply additional static pressure over and above the head pressure of the molten metal 15 in the crucible 1. As will be discussed later, the additional static pressure may be used in a control circuit to control process conditions during the cladding operation.

In an alternative embodiment, the crucible 1 may be open topped such that merely the static pressure of the molten material 15 therein provides the force necessary to flow molten metal through the passageways 23 to form the menisci 31 and continue flow after the menisci 31 are punctured by an extruded product or the like. In this embodiment, the open topped crucible may be batch filled with additional lots of molten metal, or, alternatively, filled with a solid form such as a powder which would become molten as a result of the heating means 43 prior to entry into the flow passageways 23.

Figure 5:
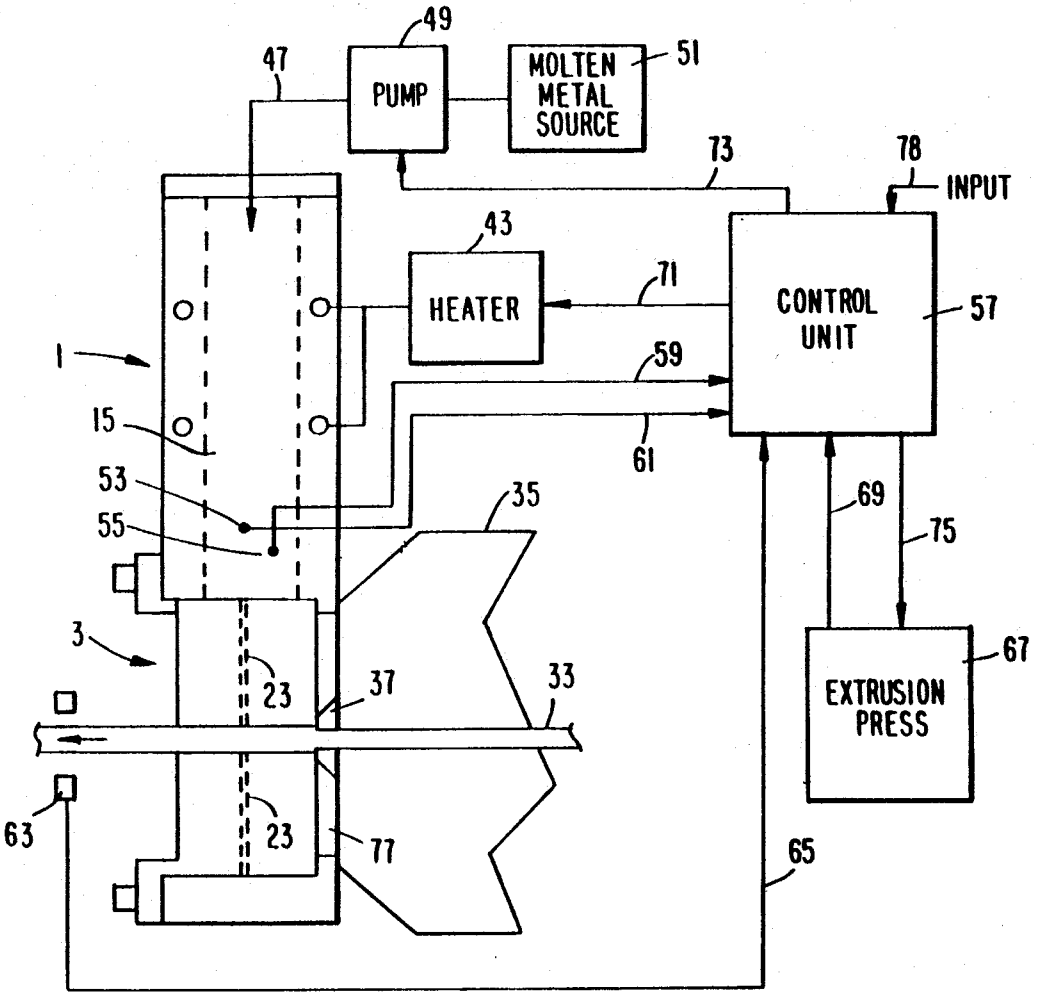
FIG. 5 shows a schematic diagram of an exemplary control circuit for the continuous molten metal cladding apparatus of FIG. 1.

FIG. 5 depicts a schematic diagram of an exemplary control scheme for the continuous molten metal cladding apparatus. In this embodiment, a pump means 49 is provided to supply a source of molten metal via the supply line 47 to the crucible 1. The molten metal pump means 49 may be any type known in the art to pump molten metal such as electromagnetic pumps. The pump means 49 may be supplied by a conventional molten metal source such as a melting furnace or the like. Alternatively, the molten metal may be fed to the crucible 1 under pneumatic pressure to maintain and control the static pressure in the crucible. In a further embodiment, a pressurizing means may be provided to control the static pressure within the crucible 1 with an additional molten metal supply pump providing continuous or intermittent refilling of the crucible 1.

The crucible also contains temperature sensing means 53 and pressure sensing means 55 disposed therein. Since these sensing means are considered to be well known in the art, no further description of these components is deemed necessary. The signals derived from the temperature and pressure sensing means, 53 and 55, respectively, are transmitted to the control means 57 via the lines 59 and 61, respectively.

A cladding thickness gauge 63 of any known type in the art capable of detecting the thickness of the cladding on the extruded product is provided downstream of the molten metal dispensing tool. The sensed cladding thickness is transmitted to the control unit 57 via the connecting line 65. An additional input to the control unit may be received from variables from the extrusion press 67 such as the speed or temperature of the extruded product 33. This information is transmitted via the connecting line 69 to the control unit 57.

The control unit may be any type known in the art capable of receiving the information provided in the connecting lines 59, 61, 65 and 69 as well as any predetermined process variables for applying the cladding molten metal to an extruded product. The control unit also includes the capability to control alone or collectively any of the heater 43, pump 49 and extrusion press 67. The control unit is suitably connected to each of these elements, respectively, by the connecting lines 71, 73 and 75, respectively.

In operation, once the extruded product 33 has passed through the molten metal dispensing tool 3, a thickness of the cladding material is sensed by the sensor 63 and inputted to the control unit 57. The control unit 57 is capable of comparing the sensed thickness value to a predetermined thickness value inputted to the control unit, for instance on line 78. The control unit, also receiving signals from the temperature and pressure sensing means and extrusion press processing parameters such as speed and temperature, can selectively control the pump means 49, heater 43 and extrusion press 67 to adjust the cladding thickness by controlling the flow of the molten metal through the flow passageways 23 and onto the surface of the extrusion. The control circuit permits automated operation of the method of continuous molten metal cladding of an extruded product and permits multi-variable control to achieve a desired cladding thickness.

It should be noted that the crucible 1, by being placed adjacent the extrusion press portion 35 may also be heated by heat contained in the portion 35 as a result of the extrusion process. To facilitate heat transfer from the extrusion press portion 35, the front wall of the crucible 5 may include a heat conducting material in the region disposed between the molten metal dispensing tool 3 and the distal end face of the extrusion press portion 35. In this manner, any heat in the extrusion press portion 35 may be conducted through this portion of the front crucible wall 5 to the molten metal dispensing tool 3 to further maintain the molten metal in a fluid state. For example, the crucible front wall 5 may include an annular metallic element configured around the extruded product 33 with the inner surface thereof forming the opening 37. The size of the annular element could coincide with the distal end face of the extruding portion 35. An example of such an element is shown as reference numeral 77 in FIG. 5. The annular element may be integrally attached to the front wall 5 of the crucible, or, alternatively, removably attachable using fasteners or the like.

Figure 6:
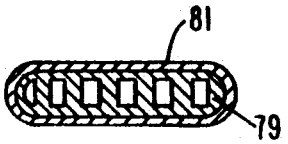
FIG. 6 shows a cross-sectional view of a clad extruded product.

FIG. 6 shows an exemplary extruded product having a cladding on the outer surface thereof. The extruded product 79 is in the form of a multi-void heat exchanger element typically comprised of an aluminum alloy. These types of heat exchange elements generally have a thickness of about ⅛ inch with an overall width approximating 1 inch. As can be seen from FIG. 6, a cladding material 81 such as zinc or a brazing alloy, which are well known in the art, is disposed on the outer surface of the product 79. It should be understood that the method of molten metal cladding an elongated member is not limited merely to aluminum alloy extruded products clad with zinc or brazing alloys. Any elongated member capable of receiving a cladding material on the outer surface thereof may be used in the inventive apparatus and method for continuous molten metal cladding. Elongated products may be tubular or multi-voided as shown in FIG. 6 or, alternatively, solid core such as a rod or bar.

As such, an invention has been disclosed in terms of preferred embodiments thereof which fulfill each and every one of the objects of the present invention as set forth hereinabove and provide a new and improved method of and apparatus for continuous molten metal cladding of elongated members.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A continuous molten metal cladding tool apparatus comprising:

a) a crucible for retaining a molten metal; and b) a molten metal dispensing means for cladding an elongated member with said molten metal, said crucible and said molten metal dispensing means forming a chamber for holding said molten metal, said molten metal dispensing means further comprising;

a dispensing tool having a first opening for passage of said elongated member therethrough, and a plurality of second openings therethrough, each said second opening providing communication between said chamber and said first opening to form a meniscus of molten metal at a distal end of each of said second openings, each said meniscus being adapted for contacting an outer surface of said elongated member to clad said molten metal thereon.

2. The apparatus of claim 1 wherein said crucible further comprises a recess for receiving said molten metal dispensing means, said molten metal dispensing means being removably insertable in said recess.

3. The apparatus of claim 2 further comprising retaining means for securing said removable molten metal dispensing means within said recess.

4. The apparatus of claim 1 further comprising heating means for maintaining said molten metal in a molten state.

5. The apparatus of claim 1 wherein said dispensing tool further comprises a disk.

6. The apparatus of claim 5 wherein the circumferential surface of said disk includes a channel therearound to facilitate flow of molten metal through each of said second openings.

7. The apparatus of claim 4 further comprising means for pressurizing said molten metal in said chamber to facilitate flow of molten metal through each of said second openings.

8. The apparatus of claim 7 wherein said means for pressurizing said molten metal further comprises pump means, said pump means further providing a supply of molten metal to said chamber.

9. The apparatus of claim 7 further comprising control means for controlling the thickness of cladding on said elongated member.

10. The apparatus of claim 9 wherein said control means further comprises:

i) molten metal temperature sensing means;

ii) means for sensing cladding thickness of said elongated member;

iii) means responsive to said means for sensing cladding thickness for controlling of said heating means, said means for pressurizing said molten metal and speed of said elongated member passing through said first opening.

11. The apparatus of claim 1 further comprising an extrusion press disposed adjacent to said apparatus and wherein said elongated member comprises an extruded product formed by said extrusion press, said extruded product passing directly into said first opening thereby minimizing formation of oxide on the surface of said extruded product prior to cladding.

12. A method of continuous cladding of an elongated member using a molten metal comprising the steps of:

a) providing an elongated member;

b) providing a cladding molten metal;

c) forming a plurality of menisci of said cladding metal;

d) puncturing each of said menisci by passing said elongated member therethrough to continuously flow said cladding molten metal on the surface of said passing elongated member; and e) solidifying said molten metal on said elongated member to form a clad elongated member.

13. The method of claim 12 wherein said forming step further comprising providing a plurality of passageways and subjecting said cladding molten metal to a static pressure such that said molten metal in each of said passageways forms a meniscus at a distal end of each said passageway.

14. The method of claim 12 wherein said clad elongated member has a cladding metal thickness of about 0.001 inch to 0.005 inch.

15. The method of claim 13 further comprising the step of controlling the flow of said cladding molten metal responsive to a sensed cladding metal thickness.

16. The method of claim 15 wherein said controlling step further comprises controlling said static pressure applied to said cladding molten metal to control said flow of said cladding molten metal.

17. The method of claim 12 wherein step (a) further comprises providing an extruded product as said elongated member for passing through said menisci.

18. The method of claim 17 wherein said extruded product is passed through each of said menisci immediately following a step of extruding said product such that said extruded product's surface is substantially oxide free to improve adhesion between said surface and said cladding molten metal.

19. A continuous molten material cladding tool apparatus comprising:

a) a crucible for retaining a molten material; and b) a molten material dispensing means for cladding an elongated member with said molten material, said crucible and said molten material dispensing means forming a chamber for holding said molten material, said molten material dispensing means further comprising:

a dispensing tool having a first opening for passage of said elongated member therethrough, and a plurality of second openings therethrough, each said second opening providing communication between said chamber and said first opening to form a meniscus of molten material at a distal end of each of said second openings, each said meniscus being adapted for contacting an outer surface of said elongated member to clad said molten material thereon.

* * * * *